US006634334B1

(12) United States Patent
Hwang et al.

(10) Patent No.: US 6,634,334 B1
(45) Date of Patent: Oct. 21, 2003

(54) ENGINE IDLE SPEED CONTROL DEVICE

(75) Inventors: Seon-Yang Hwang, Kyungki-Do (KR); Sung-Nam Baek, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/138,897

(22) Filed: May 2, 2002

(51) Int. Cl.[7] ..... F02M 41/08

(52) U.S. Cl. ..... 123/339.23; 123/339.24; 123/337

(58) Field of Search ..... 123/339.22, 339.23, 123/339.24, 337

(56) References Cited

U.S. PATENT DOCUMENTS

| | | | | |
|---|---|---|---|---|
| 4,128,085 A | | 12/1978 | Kunii | |
| 4,420,972 A | | 12/1983 | Kuroiwa et al. | |
| 4,426,968 A | | 1/1984 | Onuki et al. | |
| 4,584,981 A | | 4/1986 | Tanabe et al. | |
| 4,662,334 A | | 5/1987 | Wietschorke et al. | |
| 4,700,676 A | | 10/1987 | Harashima et al. | |
| 4,771,749 A | * | 9/1988 | Kiuchi et al. | 123/339.23 |
| 4,856,475 A | * | 8/1989 | Shimomura et al. | 123/339.21 |
| 5,048,483 A | * | 9/1991 | Nakazawa | 123/339.24 |
| 5,113,826 A | | 5/1992 | Anzai | |
| 5,415,143 A | * | 5/1995 | Togai | 123/339.22 |
| 5,582,148 A | * | 12/1996 | Hashimoto et al. | 123/339.22 |
| 5,651,342 A | * | 7/1997 | Hara | 123/339.24 |
| 5,711,271 A | * | 1/1998 | Schlagmueller et al. | 123/339.24 |
| 6,334,430 B1 | | 1/2002 | Itabashi | |

* cited by examiner

*Primary Examiner*—Erick Solis
(74) *Attorney, Agent, or Firm*—Pennie & Edmonds LLP

(57) ABSTRACT

An engine idle speed control device enhances engine cold-start performance even in engines of large displacement. The device reduces noise created by intersecting air flows after bypassing the throttle valve. The device includes first and second passages, each mounted on a throttle body for enabling air flow bypassing the throttle valve, an ISA so mounted as to control the opening of the first passage, and temperature valve unit so mounted as to control the opening of the second passage in response to engine temperature.

12 Claims, 6 Drawing Sheets

ENGINE IDLE SPEED CONTROL DEVICE

FIELD OF THE INVENTION

The present invention relates to an engine idle speed control device adapted to bypass an engine throttle valve to provide air to an engine combustion chamber, and, more particularly, to an engine idle speed control device adapted to improve starting ability when an engine is cold and to accurately effect engine idle control.

BACKGROUND OF THE INVENTION

FIG. 1 illustrates a conventional idle speed control device using a step motor. A throttle body 1 is mounted with an Idle Speed Control (ISC) passage 3 for bypassing a throttle valve 2. The ISC passage 3 is equipped with an Idle Speed Control Actuator (ISA 4) for controlling the opening of ISC passage 3 by way of step motor, and in parallel therewith, a Fast Idle Air Valve (FIAV 5) is mounted to smooth engine start when the vehicle is cold-started. When the engine is cold-started, the FIAV(5) is in a state of opening the ISC passage (3), such that additional air is supplied to air provided through passage 3 and ISA(4), to thereby facilitate initial startup.

However, there is a problem in the engine idle speed control device thus described in that the ISA(4) and the FIAV(5) are mounted in parallel on a single ISC passage 3. Thus, even if the opening of FIAV(5) is large, the air supplied to the combustion chamber via ISC passage 3 is restricted by the cross-sectional area of ISC passage 3, such that full and smooth cold-starting of the engine cannot be accomplished in large displacement engines.

SUMMARY OF THE INVENTION

The present invention provides an engine idle speed control device that facilitates cold-starting, including in large displacement engines. In accordance with a preferred embodiment of the present invention, first and second passages are mounted on a throttle body to enable air flow bypassing the throttle valve. An ISA is mounted to control the opening of the first passage. Temperature valve means is mounted to control the opening of the second passage in response to engine temperature.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Embodiments of the present invention will now be described in detail with reference to the accompanying drawings.

Figure 1:
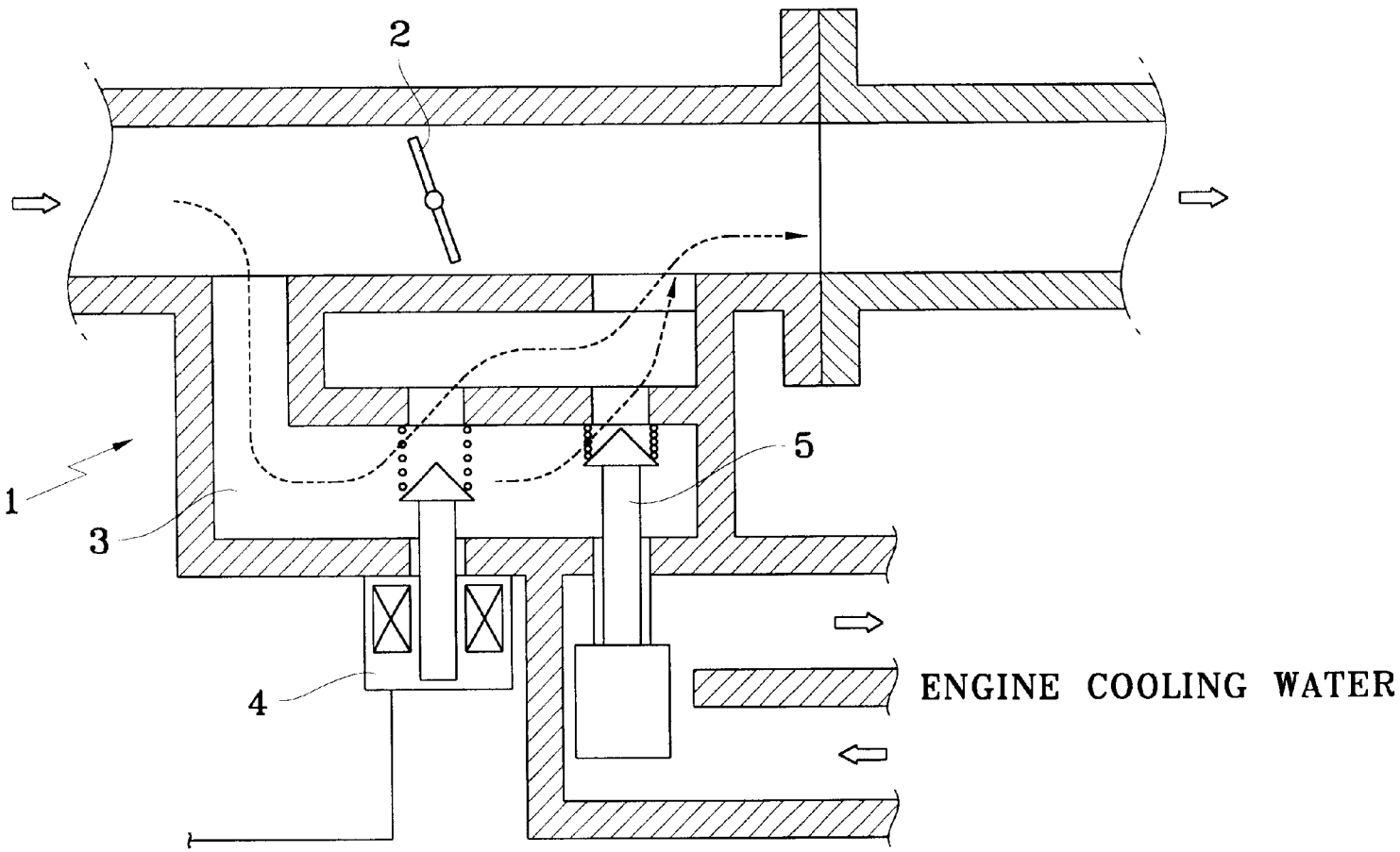
FIG.1 (Prior art)
FIG. 1 is a schematic drawing illustrating an engine idle speed control device according to the prior art.
Figure 2:
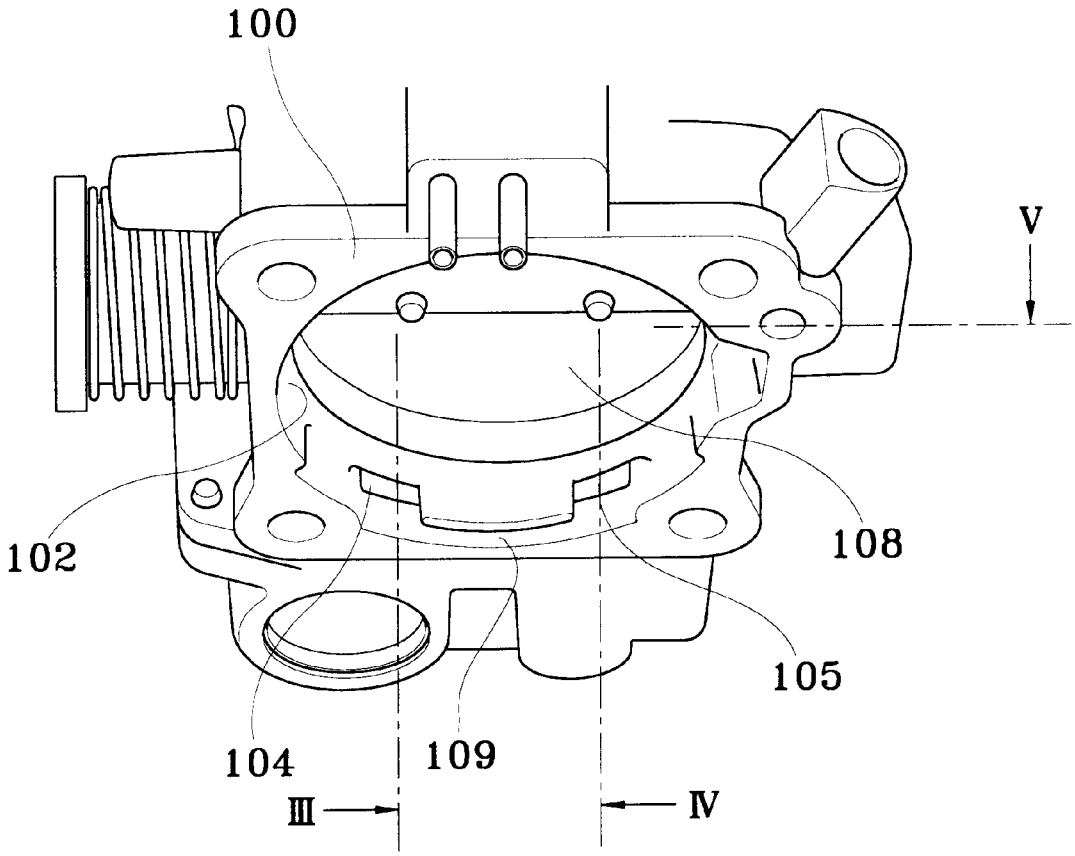
FIG. 2 is a rear perspective view of a throttle body mounted with an engine idle speed control device according to the present invention.
Figure 3:
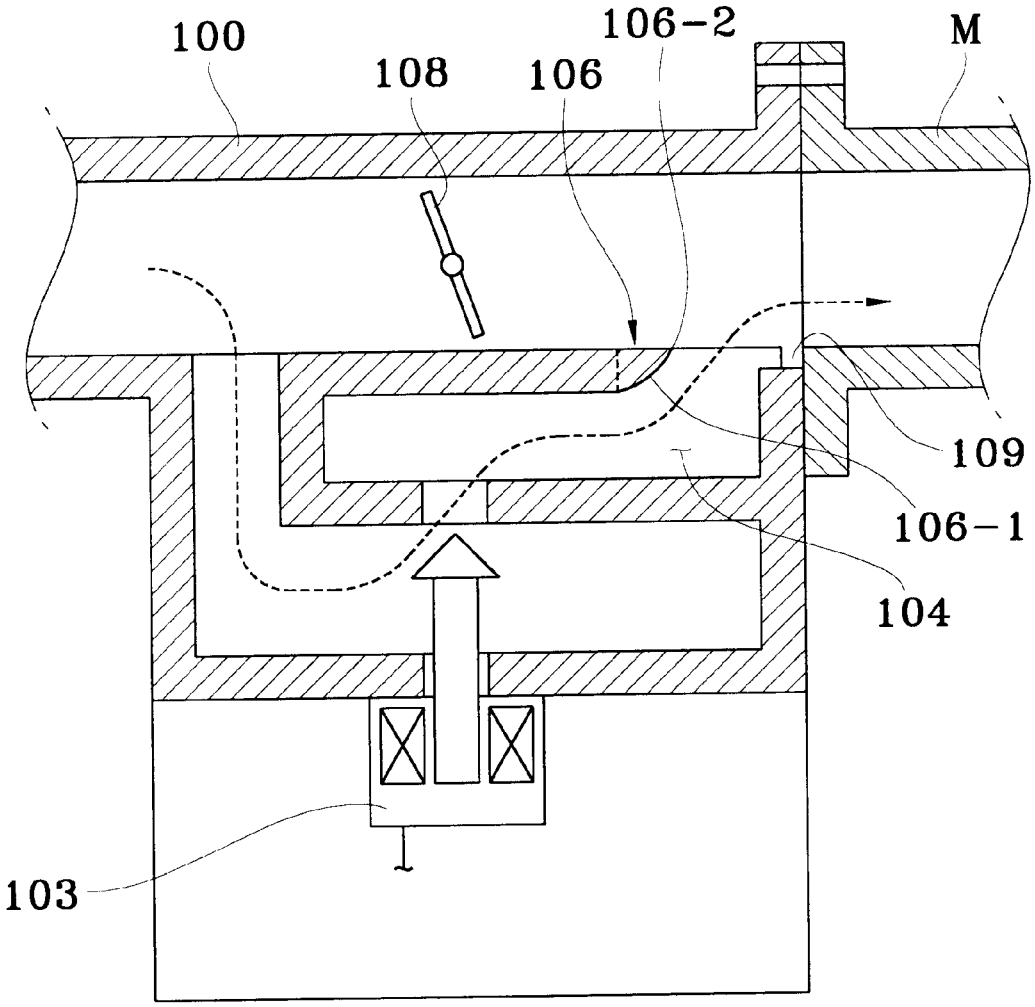
FIG. 3 is a sectional view taken along line III of FIG. 2.
Figure 4:
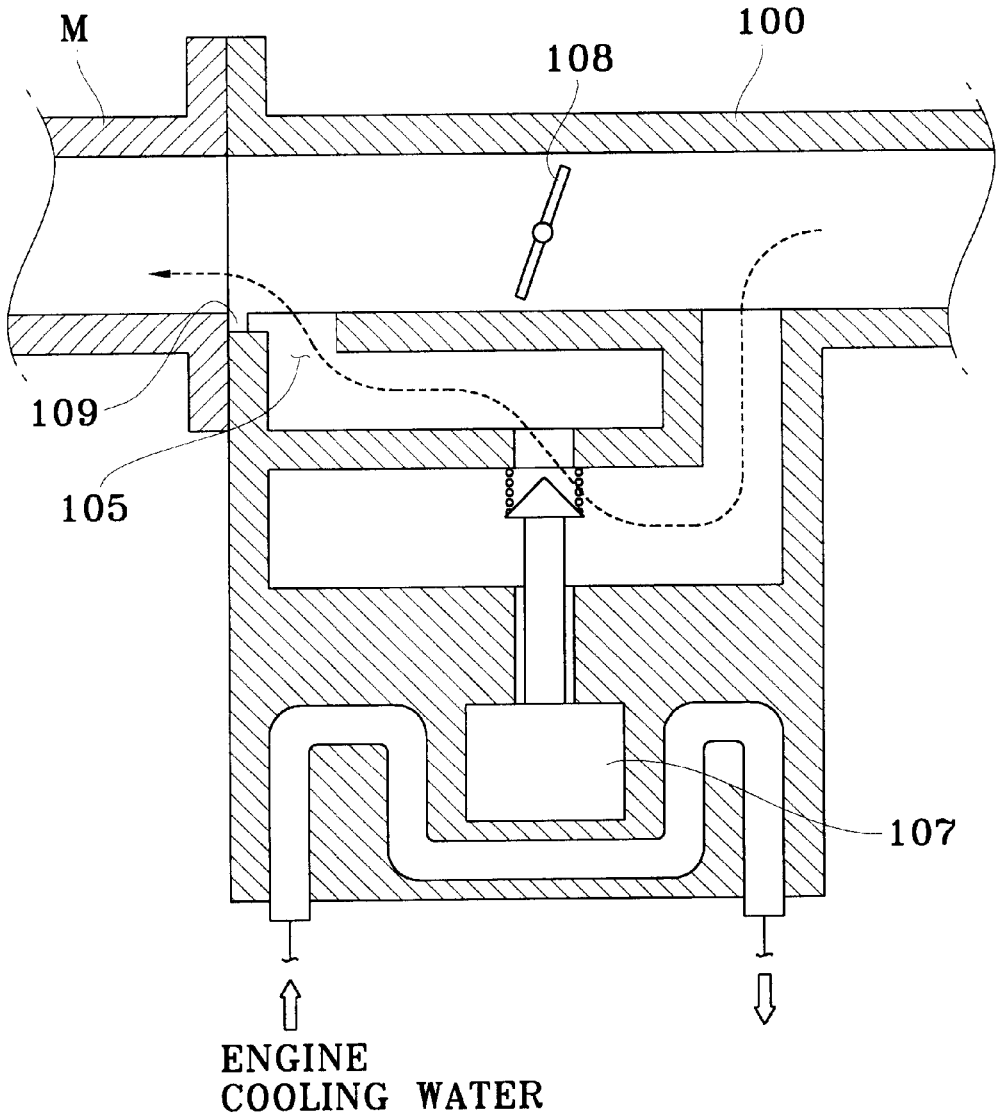
FIG. 4 is sectional view taken along line IV of FIG. 2.

As shown in FIGS. 2, 3 and 4, an engine idle speed control device according to the present invention includes a throttle body 100 equipped with a throttle valve 108 for controlling amount of air drawn into a combustion chamber in response to a driver's manipulation of the accelerator pedal. The air passage mounted with the throttle valve 108 is referred to as main passage 102. Throttle body 100 also defines a first passage 104 and a second passage 105 for bypassing the throttle valve 108 to allow the air to pass therethrough. The first and second passage 104 and 105 are air passages communicating with an upper flow side and a lower side of the main passage 102 relative to the throttle valve 108.

First passage 104 includes therein an ISA 103 in order to control the opening size of the first passage 104 as illustrated in FIG. 3. Second passage 105 includes therein temperature valve means 107 for controlling the opening of the second passage in response to engine temperature. In a preferred embodiment, the valve means comprises a wax-driven temperature valve containing wax that is expanded or shrunken according to the temperature of engine cooling water to open the second passage when the temperature is below a predetermined temperature and to close the second passage when the temperature is above a predetermined temperature.

In one preferred embodiment, the predetermined temperature for the wax-driven temperature valve to block the second passage 105 is about 50 degrees celsius. Thus, when the temperature reaches 50 degrees Celsius, the second passage 105 is completely shut off to stop additional air flow through the second passage 105. The predetermined temperature may be appropriately otherwise selected according to engine model and operation by one of ordinary skill in the art.

One surface of main passage 102 is formed with a noise-proof groove 109 connecting the outlets of the first and second passages 104, 105 in a downstream direction. In a preferred embodiment, where the throttle body 100 is mounted on a suction side structure (M) of the engine, such as surge tank and the like, the noise-proof groove 109 is formed between a cut-away part at the throttle body 100 and the suction side structure (M). Alternatively, the noise-proof groove 109 may be formed on the throttle body 100 independently instead of being formed with the suction side structure (M) thus mentioned.

Figure 5:
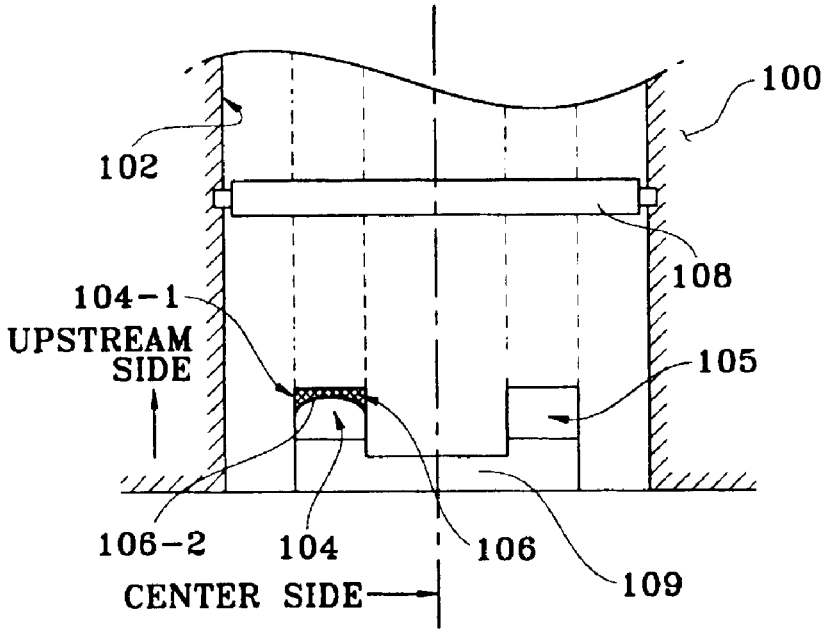
FIG. 5 is a sectional view taken along V of FIG. 2.

As shown in FIGS. 3 and 5, an outlet area (104-1) of the first passage 104 includes a curved edge part 106 to form an outlet having a smaller sectional area than the average sectional area of ISC passage 104. The curved edge part 106 reduces or prevents noise generation when air infused into the engine via main passage 102 and air infused via the first passage 104 abruptly collide upon engine acceleration, and serves to cushion the air supplied through the first passage 104 and smooth the air flow at the intersection with the main passage.

Outlet area 104-1, as shaped by curved edge part 106, forms a nozzle-like passage that directs flow from first passage 104 so as to minimize flow resistance and impact on the flow in main passage 102. Curved edge part 106 is preferably oriented with the curved edge 106-2 along the upstream edge of outlet area 104-1. Also, an inclined or rounded-over surface 106-1 on curved edge part 106 is thus preferably formed on the underside of the upstream edge of outlet area 104-1 (See FIG. 5) to prevent sudden collision between the air flows and to provide a streamlined route of air flow through the first passage, thereby minimizing flow resistance.

Figure 6:
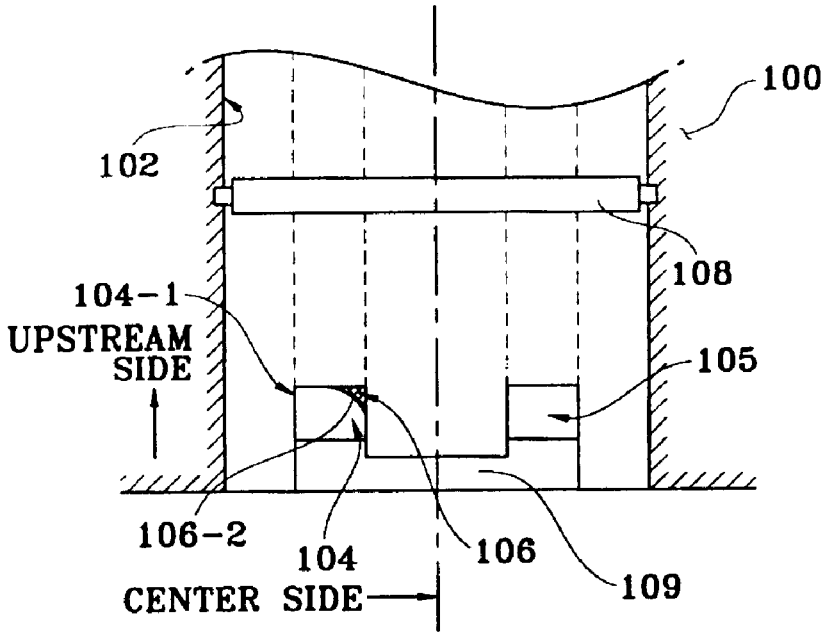
FIG. 6 is a sectional view according to another embodiment of the present invention.
Figure 7:
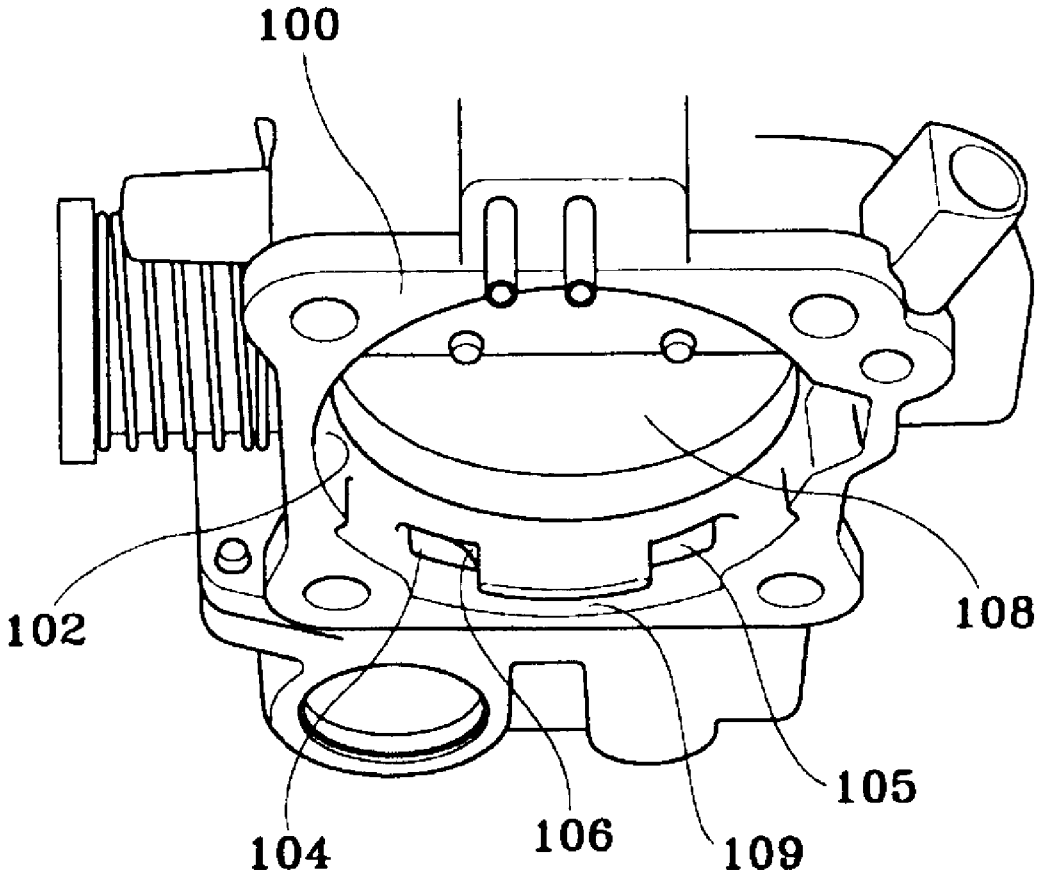
FIG. 7 is a perspective view of an alternative embodiment as shown in FIG. 6.

In a second alternative embodiment, illustrated in FIGS. 6 and 7, the curved edge part 106 has the curved edge 106-2 formed only at one corner of the upstream edge of outlet area (104-1) into main passage 102. When the throttle valve 108 is not in the wide open state, much more flow of air is generated at the central main passage 102. As one of the forms to reduce the noise created thereat, part 106-2 is provided.

Now, operation of the present invention thus constructed will be described.

When an engine is started in a cold state, temperature valve 107, disposed in second passage 105, opens the second passage 105 in response to lower sensed temperature. Additional air is thus supplied to the air provided to the combustion chamber side of the engine through the first passage 104.

Air added through the second passage 105 can be supplied independently from the air having passed the ISA 103 to enable supply of much more air to the combustion chamber side of the engine. This is unlike the prior art where the air having passed the ISA is added by the air having passed the FIAV. As a result, even in the case where much air is required in a large displacement engine, a smooth cold starting of engine can be obtained. Also, when the engine is started at a normal temperature, an accurate engine idle control can be realized when the amount of air to the first passage 104 is accurately controlled through the ISA 103, while the second passage 105 is completely blocked.

When air is provided through the first and second passage 104 and 105 thus described, noise that might be generated as air passes the rear part of the throttle body 100 can be avoided by the noise-proof groove 109. Noise-proof groove 109 allows the air flows supplied through the first passage 104 and the second passage 105 to be mixed smoothly and to be introduced into the combustion chamber with increased shock absorption and decreased resonance such that noise generated from the throttle body side in cold start of the engine can be avoided.

When the engine reaches a normal operating condition, air passes through the main passage 102 in response to the accelerator pedal being depressed by the driver. In this hotter operating state the second passage 105 is blocked by valve 107 due to the heat of the engine cooling water. Air is thus supplied through the first passage 104 creating a chance that noise can be created by collision of air flows as described. However, noise can be avoided by prevention of sudden air flow collision by installation of rounded edge part 106, which allows the air supplied through the first passage 104 to move along a streamlined route and to join the main air flow having already passed the main passage.

As apparent from the foregoing, there is an advantage in the engine idle speed control device thus described according to the present invention in that good cold-starting can be obtained, even in an engine of large displacement. Another advantage is that air flow supplied to the engine through the first passage and air flow introduced through the main passage are smoothly joined to have the same flow direction, thereby reducing the generation of noise and obtaining a quieter engine operation.

What is claimed is:

1. An engine idle speed control device, comprising:

a body defining a main passage containing a throttle valve and first and second passages enabling flow of air bypassing the throttle valve;

an ISA so mounted as to control openness of the first passage;

temperature valve means so mounted as to control openness of the second passage in response to engine temperature; and wherein the main passage is formed with outlets of the first and second passage at surface thereof with a noise-proof groove connecting the outlet of the first passage and the outlet of the second passage.

2. The device as defined in claim 1, wherein the temperature valve means is a wax-driven temperature valve where wax filled therein is shrunken or expanded in response to temperature of engine cooling water to open the second passage under a predetermined temperature and to close the second passage above the predetermined temperature.

3. The device as defined in claim 1, wherein the noise-proof groove is formed in a downstream position of the main passage with respect to the outlet areas of the first and second passage.

4. An engine idle speed control device, comprising:

a body defining a main passage containing a throttle valve and first and second passages enabling flow of air bypassing the throttle valve;

an ISA so mounted as to control openness of the first passage wherein the first passage has an outlet area into the main passage with a sectional reduced-size opening, thus forming an outlet having a smaller sectional area than an average sectional area of the first passage; and temperature valve means so mounted as to control openness of the second passage in response to engine temperature.

5. The device as defined in claim 4, wherein the sectional reduced-size opening is formed with a curved edge along an upstream edge of the outlet area of the first passage.

6. The device as defined in claim 4, wherein the sectional reduced-size opening is formed with a curved edge in an upstream, central corner of the outlet area of the first passage.

7. The device as defined in claim 4, wherein the sectional reduced-size opening is formed with an inclined surface on an underside upstream surface of outlet area.

8. The device as defined in claim 4, wherein the outlet has an upstream part formed in a smooth streamlining profile.

9. An engine idle speed control device for a throttle including a throttle body with a throttle valve disposed in a main air passage way, the device comprising:

first and second air passageways defined by the throttle body, each having an inlet and outlet to the main passageway to provide airflow bypasses around the throttle valve;

a first valve mounted in the first passage way to control air flow therethrough based on engine idle speed;

a second valve mounted in the second passageway to control air flow therethrough based in engine temperature; and a restriction at the outlet of the first passage way configured and dimensioned to provide the outlet with a cross-sectional area less than an average cross-sectional area of the first passage way.

10. The device according to claim 9, wherein said restriction is further configured and dimensioned to direct air flow from the first passageway into the main passageway in a down stream direction and to minimize disturbance of the airflow in the main passageway.

11. The device according to claim 9, wherein said first valve comprises an idle speed actuator.

12. The device according to claim 9, wherein said second valve is a wax-driven temperature valve.

* * * * *